US006547018B1

(12) United States Patent
Choi

(10) Patent No.: US 6,547,018 B1
(45) Date of Patent: Apr. 15, 2003

(54) TRANSMISSION FOR WHEELCHAIR

(75) Inventor: Tae-Youn Choi, 102-1107 Henydai Apt, Yeonsan 8 Dong, Yeonjae-ku, Pusan 611-088 (KR)

(73) Assignees: Su-Gil Choi, Woosan (KR); Tae-Youn Choi, Pusan (KR)

( * ) Notice: Subject to any disclaimer, the term of this patent is extended or adjusted under 35 U.S.C. 154(b) by 0 days.

(21) Appl. No.: 09/936,945

(22) PCT Filed: Apr. 1, 2000

(86) PCT No.: PCT/KR00/00298

§ 371 (c)(1),
(2), (4) Date: Oct. 11, 2001

(87) PCT Pub. No.: WO00/59440

PCT Pub. Date: Oct. 12, 2000

(65) Prior Publication Data

(65)

(30) Foreign Application Priority Data

Apr. 2, 1999 (KR) ..... 99-5420
Mar. 21, 2000 (KR) ..... 00-9012

(51) Int. Cl.[7] ..... A61G 5/04

(52) U.S. Cl. ..... 180/11; 180/368; 180/907; 180/65.6

(58) Field of Search ..... 180/368, 11, 15, 180/907, 205, 206, 65.1, 65.6, 65.7

(56) References Cited

U.S. PATENT DOCUMENTS 4,050,533 A * 9/1977 Seamone ..... 180/6.5
5,762,154 A * 6/1998 Hsu ..... 180/15

FOREIGN PATENT DOCUMENTS

CH 649464 5/1985
DE 4202687 A1 * 8/1993 ..... A61G/5/04
JP A9285501 2/1998
JP A10014987 4/1998

* cited by examiner

*Primary Examiner*—Kevin Hurley
(74) *Attorney, Agent, or Firm*—Birch, Stewart, Kolasch & Birch, LLP

(57) ABSTRACT

A transmission for a wheelchair capable of selecting a manually operated manner and a motor-driven manner. The transmission includes: a transmission unit installed on the wheelchair for driving the wheelchair; a clamping unit for fixing the transmission unit on the wheelchair; and a switching unit for switching the wheelchair in the manual and motor-driven ways; wherein the transmission unit comprises, driving rollers coupled to accelerator and decelerators connected to motors on the both sides of the interior of a casing, for driving both wheels, and a controller circuit-connected to the motors, a motor control circuit unit and a battery, for adjusting the transmission unit, wherein the switching unit comprises, a fixing clip assembled by means of the clamping unit with the casing of the transmission unit and having a locking projection locked or unlocked to/from a locking hole of a fixing part fixed on the frame of the wheelchair, a locker elastically coupled with first and second springs on the top and bottom portions of the interior of the fixing clip and for pulling upward by means of a handle, the locking projection elastically protruded on the both sides of the locker, respectively and locked or unlocked to/from the locking hole of the fixing part, a first pulling string connected to a push button elastically installed by means of a third spring on the handle, for pulling the locker with the locking projection by the pressing operation of the push button, to thereby isolate the driving rollers on the both sides of the transmission unit from the wheels, and a ratchet for controlling the manipulation of the handle by means of a stopper connected by a second pulling string to the push button of the handle.

3 Claims, 13 Drawing Sheets

TRANSMISSION FOR WHEELCHAIR

This application is the national phase under 35 U.S.C. §371 of PCT International Application No. PCT/KR00/00298 which has an International filing date of Apr. 1, 2000, which designated the United States of America.

TECHNICAL FIELD

The present invention relates to a transmission for a wheelchair, and more specifically, to a transmission for a wheelchair capable of selecting manual and motor-driven ways.

BACKGROUND ART

Typically, the wheelchair is provided with a ring-shaped driving wheel (or a wheel for a handle grip) on the outsides of the both wheels thereof, respectively, which is rolled and moved by using the hand of a user.

The conventional wheelchair does not have any problem in rolling and moving by the hands of the user, but it is found that it is not convenient for those who are difficult to use and move the wheelchair in a manual way. To solve this problem, a variety of transmission wheelchairs capable of being driven in a motor-driven way are developed.

However, the conventionally developed transmission wheelchairs have the defects that the transmission is configured in a complicated manner and the weight thereof is substantially heavy, such that it is greatly restricted to the user such as a disabled person. Moreover, the conventional transmission wheelchairs are used exclusively for the motor-driven way, and upon demand of use in the manual way, they are inconvenient to change to the desired manual way. Actually, due to the heavy weight of the transmission, it is impossible to use the manual way.

DISCLOSE OF THE INVENTION

An object of the invention is to provide a transmission for a wheelchair capable of providing a simple construction and all conveniences in use, providing a unit for freely selecting manual and motor-driven ways, making the weight thereof substantially light to thereby prevent the occurrence of the inconvenience in use caused due to the weight of the transmission when in the manual way, and improving the durability thereof and the reliability of operation.

To achieve this and other objects of the present invention, according to the present invention, a transmission for a wheelchair which is installed on a frame for the wheelchair and for selecting and driving the wheelchair in manual and motor-driven ways, which includes: a transmission unit installed on the wheelchair for driving the wheelchair; a clamping unit for fixing the transmission unit on the wheelchair; and a switching unit for switching the wheelchair in the manual and motor-driven ways; wherein the transmission unit comprises, driving rollers coupled to accelerator and decelerators connected to motors on the both sides of the interior of a casing, for driving both wheels, and a controller circuit-connected to the motors, a motor control circuit unit and a battery, for adjusting the transmission unit, wherein the switching unit comprises, a fixing clip assembled by means of the clamping unit with the casing of the transmission unit and having a locking projection locked or unlocked to/from a locking hole of a fixing part fixed on the frame of the wheelchair, a locker elastically coupled with first and second springs on the top and bottom portions of the interior of the fixing clip and for pulling upward by means of a handle, the locking projection elastically protruded on the both sides of the locker, respectively and locked or unlocked to/from the locking hole of the fixing part, a first pulling string connected to a push button elastically installed by means of a third spring on the handle, for pulling the locker with the locking projection by the pressing operation of the push button, to thereby isolate the driving rollers on the both sides of the transmission unit from the wheels, and a ratchet for controlling the manipulation of the handle by means of a stopper connected by a second pulling string to the push button of the handle.

It is to be understood that both the foregoing general description and the following detailed description are exemplary and explanatory and are intended to provide further explanation of the invention as claimed.

BRIEF DESCRIPTION OF THE DRAWING

Other objects, advantages and details of the transmission for a wheelchair of this invention appear in the following detailed description of preferred embodiments of the invention, the detailed description referring to the drawings in which.

BEST MODE FOR CARRYING OUT THE INVENTION

The present invention will now be described with reference to the illustrated embodiments.

Figure 1:
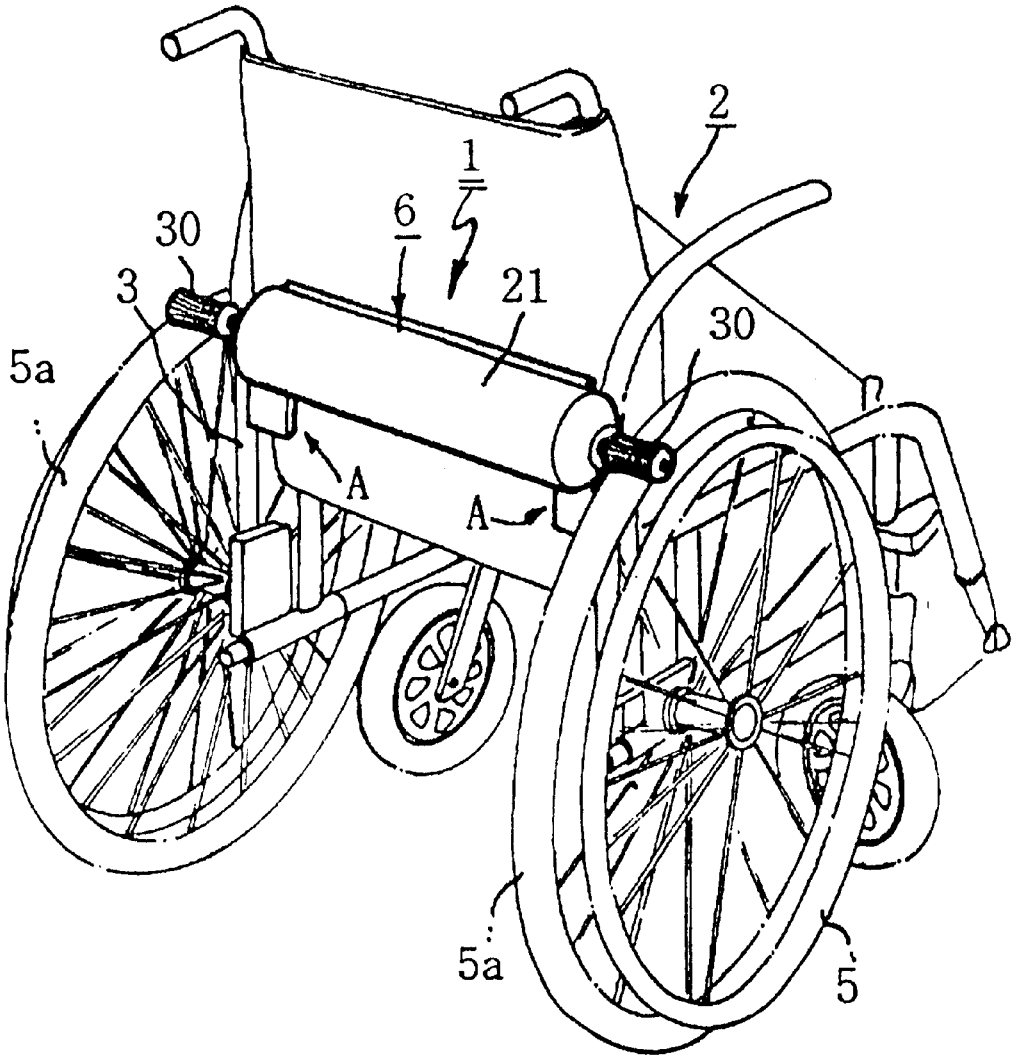
FIG. 1 is a perspective view of the rear surface of a wheelchair in which the transmission of the present invention is employed.
Figure 2:
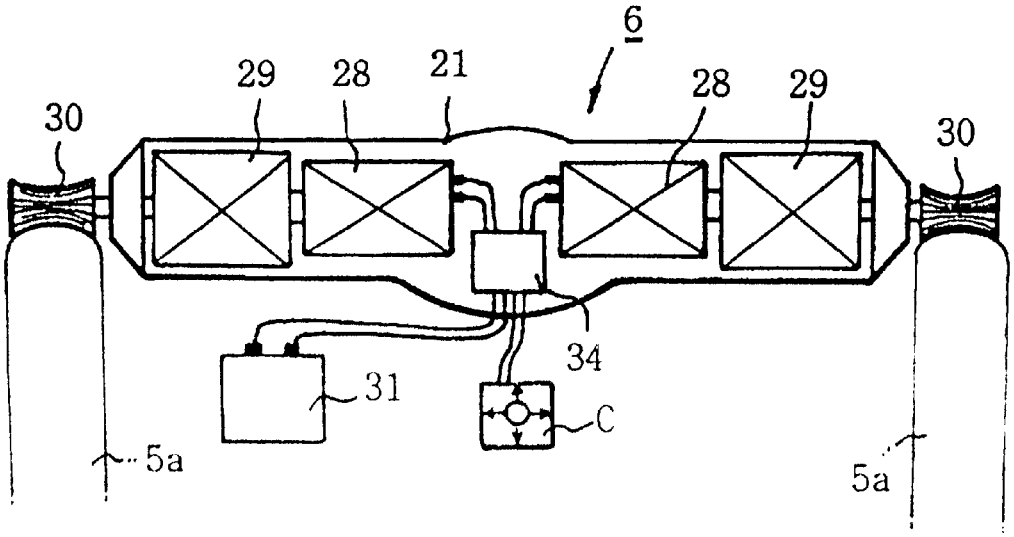
FIG. 2 is a schematic top view of the transmission unit as a main part of the transmission of the present invention.
Figure 3:
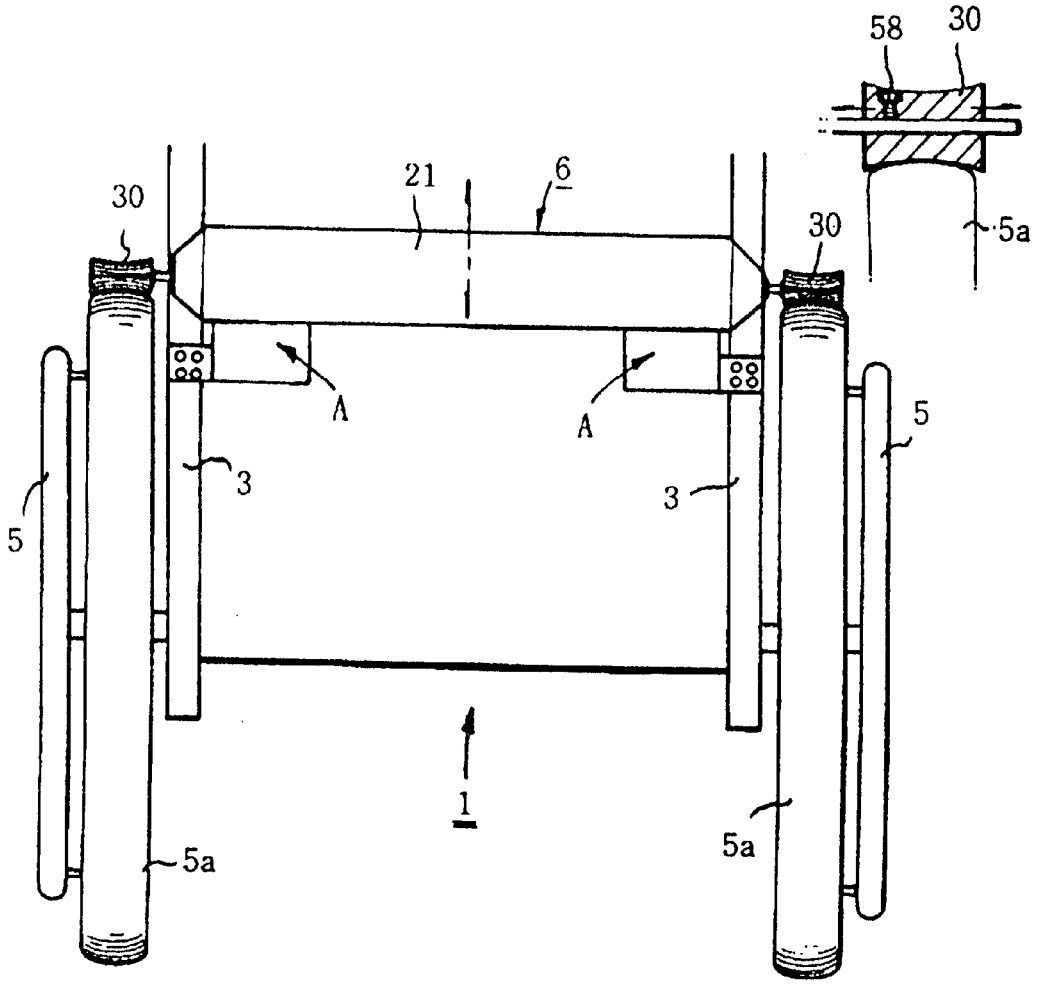
FIG. 3 is a rear view of the transmission of the present invention employed in the wheelchair.

FIG. 1, is a perspective view of the rear surface of a wheelchair 2 in which the transmission 1 for the wheelchair of the present invention is employed, FIG. 2 is a schematic top view of the transmission unit 6 as a main part of the transmission 1 of the present invention, and FIG. 3 is a rear view of the transmission 1 of the present invention employed in the wheelchair 2.

Generally, the wheelchair 2 is provided with a wheel 5*a* on the both sides thereof, respectively and a driving wheel 5 coupled to the outside of the wheel 5*a* for rolling the wheel 5*a* by the hand of a user. The transmission for the wheelchair, according to the present invention, is provided with the transmission unit 6 which is in a close contact with the wheel 5*a* to rotatably drive the wheel 5*a* and is coupled to a switching unit 'A' capable of selecting manual and motor-driven ways.

As shown in FIG. 2, the construction according to a first embodiment of the transmission unit 6 is as follows:

A motor 28, connected to a battery 31, is first installed in the internal both sides of a casing 21, respectively and connected to an accelerating and decelerating parts 29 on the both sides of the casing 21, respectively. A driving roller 30 is shaft-coupled to the both accelerating and decelerating parts 20 on the outsides of the casing 21, respectively.

The motor 28 is connected to a motor control circuit unit 34 circuit-connected to the battery 31 and a controller 'C', and the controller 'C' is mounted on a predetermined position of the wheelchair 2, for supplying and stopping the power of the motor 28, thereby rotating forwardly and reversely the motor 28 for the direction control of the wheelchair 2.

In order for the driving roller 30 to be in close contact with the outer peripheral surface of the wheel 5*a* on the each side of the wheelchair 2 and to thus rotate the wheel 5*a* by the close contact force, it is preferably formed by a rubber material having an excellent friction force and taking a prominence and depression shape.

A clamping unit 4 of the first embodiment is installed on the one side of the casing 21 of the transmission unit 6 and thus coupled attachably and detachably to/from the switching unit 'A' which is fixedly installed on a frame 3 of the wheelchair 2, for the use in the manual and motor-driven ways. Now, an explanation of the construction of the switching unit 'A', which is coupled with the transmission unit 6 to cause the driving roller 30 to be contacted or deviated with/from the wheel 5*a* of the wheelchair 2, will be discussed.

Figure 4:
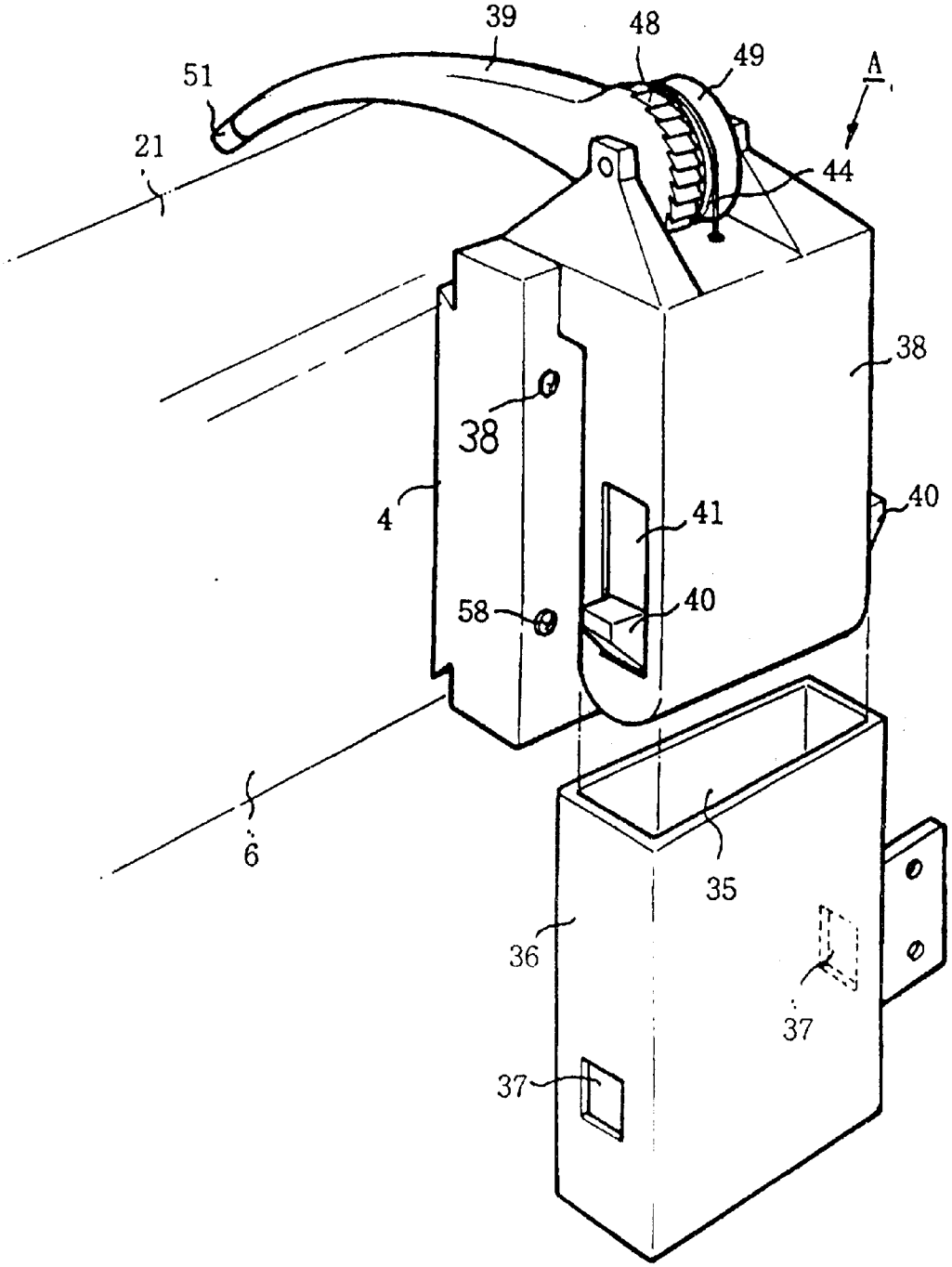
FIG. 4 is an exploded perspective view of the clamping unit and the switching unit as main parts of the transmission of the present invention.

As shown in FIG. 4, the switching unit 'A' is provided with a fixing part 36 with an assembling reentrant hole 35 which is fixed on the frame 3 of the each side of the wheelchair 2. The fixing part 36 forms a locking hole 37, and a fixing clip 38, which is assembled by means of the clamping unit 4 with the casing 21 of the transmission unit 6, is inserted into the fixing part 36. At this time, a locking projection 40 on the fixing clip is locked and unlocked to/from the locking hole 37 to thereby permit the driving roller 30 of the each side of the transmission unit 6 to be contacted or deviated with/from the wheel 5*a* of the wheelchair 2, such that the wheelchair 2 can move in the manual and motor-driven ways. Next, a detailed explanation of the construction of the switching unit 'A' will be given.

The fixing part 36 with the locking hole 37 on the both sides thereof, respectively is fixedly assembled to the frame 3 of the wheelchair 2. The casing 21 of the transmission unit 6 is coupled to the fixing clip 38 by means of the clamping unit 4. The locking projection 40 of the fixing clip 38 is inserted into the assembling reentrant hole 35 of the fixing part 36 by means of a handle 39, thereby being locked and unlocked to/from the locking hole 37.

Figure 5:
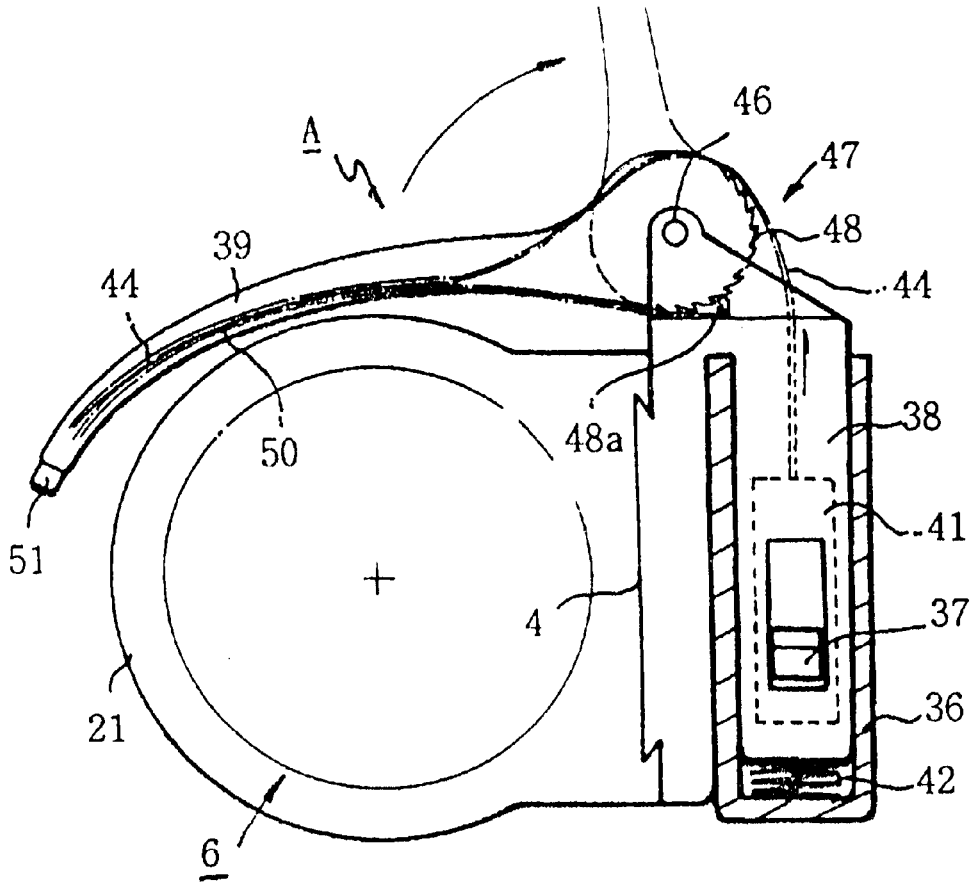
FIG. 5 is a side view of the operational state of the switching unit as the main part of the transmission of the present invention.
Figure 6:
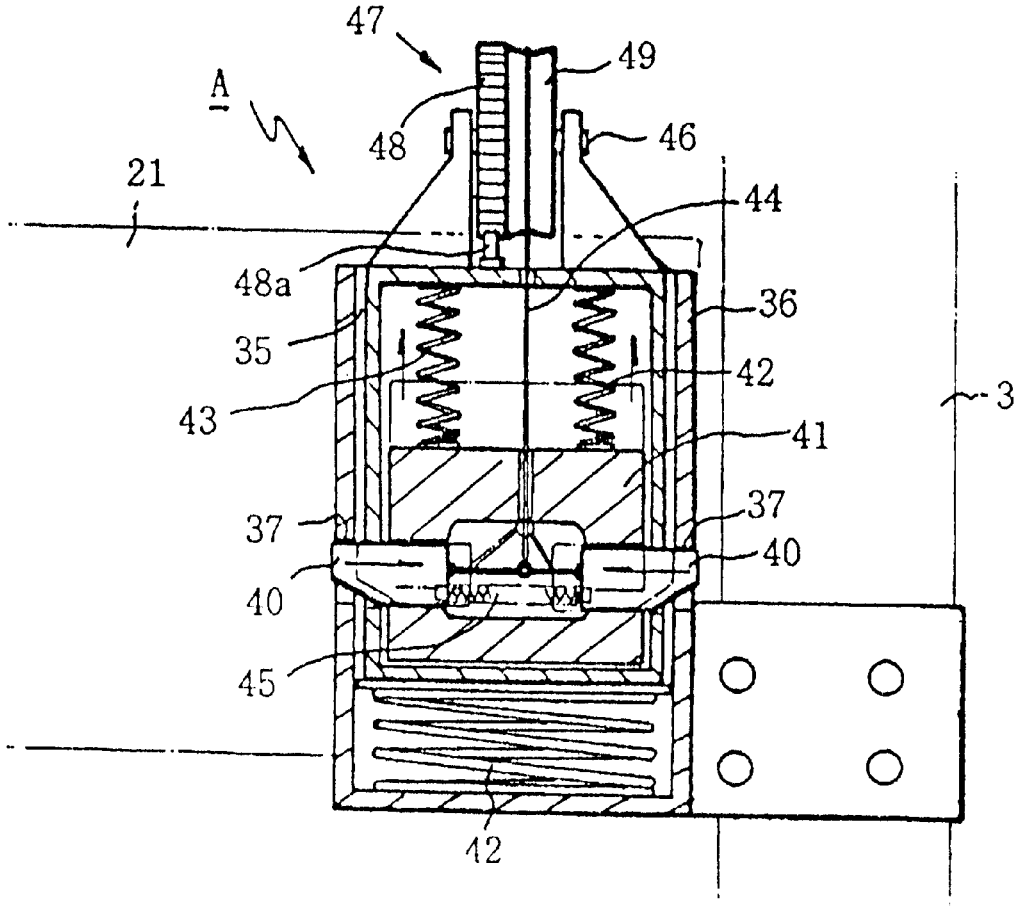
FIG. 6 is a sectional view of the operational state of the switching unit as the main part of the transmission of the present invention.
Figure 7:
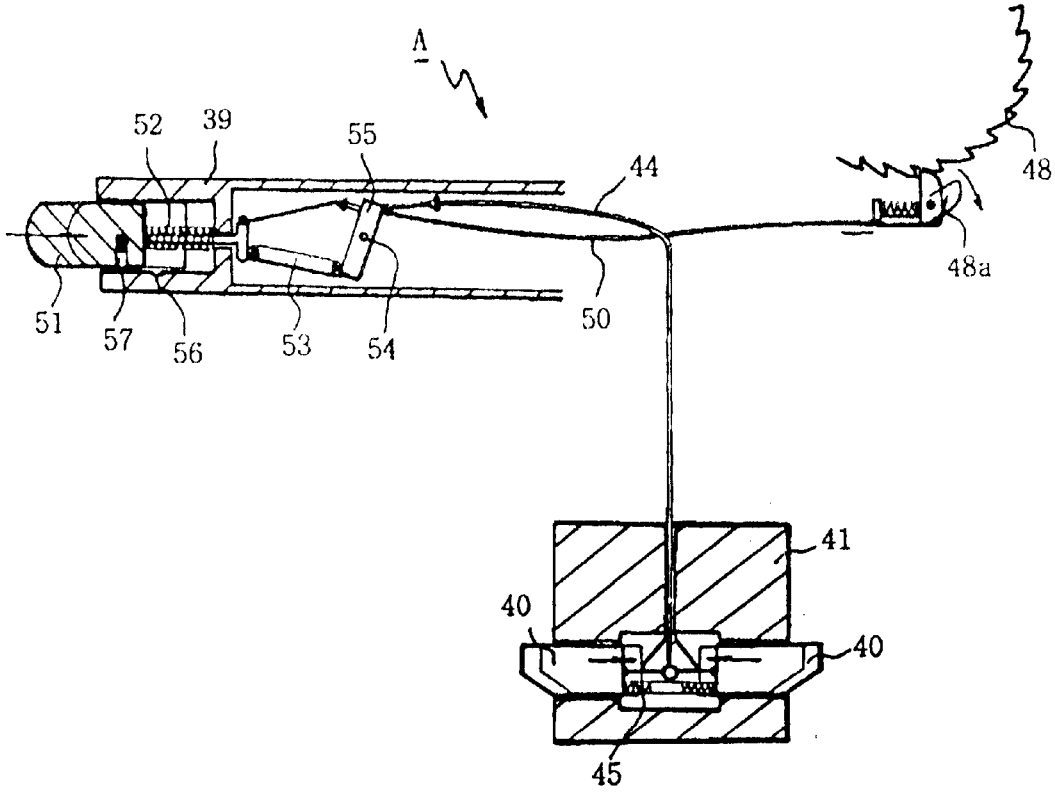
FIG. 7 is an enlarged sectional view of the operational state of the switching unit as the main part of the transmission of the present invention.

As mentioned above, the fixing clip 38 coupled to the casing 21 of the transmission unit 6 is inserted into the assembling reentrant hole 35 of the fixing part 36. In more detail, the fixing clip 38 is elastically coupled to a spring 42 at the bottom side of a locker 41 to which the locking projection 40 on the bottom surface of the inside of the locker 41 is sliding-coupled at the side thereof, as shown in FIG. 5 and is elastically coupled to a spring 43 on the top portion thereof, as shown in FIG. 6, such that the locking projection 40 of each side of the locker 41 are locked to the locking hole 37 of the fixing part 36.

The locking projections 40 of the both sides of the locker 41 are connected to a pulling string 44 which is connected to the handle 39, and between the locking projections 40, a return spring 25 is elastically provided.

On the other hand, the handle 39 on the top side of the fixing clip 38 is installed in such a fashion that it can be angle-moveable to the straight top portions of the casing 21 of the transmission unit 6 and the fixing clip 38, centering around a shaft pin 46. A rotary unit 47 of the handle 39 is composed of a ratchet 48 and a guide roller 49, the ratchet 48 being locked to one side thereof by means of a stopper 48*a* and the guide roller 49 being connected to a pulling string 30 which is connected to the top portion of the locker 41.

On the end of the handle 39 a push button 51 is provided to selectively contact and release the driving rollers 30 of the both sides of the transmission unit 6 to/from the wheels 5*a*.

In other words, the push button 51 is assembled to be elastically supported outwardly on the end of the handle 39 by means of an inside spring 52. The one end of the push button 51 coupled to the spring 52 is coupled by means of a link 53 to the one end of a rotary plate 55 assembled to a shaft pin 54, and if the push button 51 is pressed, the other end of the rotary plate 55 on the axis of the shaft pin 54 is angle-moved to the push button 51. The pulling strings 44 and 50, each connected to the stopper 48*a* and the locking projection 40 of the locker 41, are connected to the other end of the rotary plate 55.

On the other hand, upon pushing the push button 51, a fixing pin 57 is elastically assembled to a fixing groove 56 on the inside of the handle 39. The fixing pin 57 is adapted to fix the pushing state upon the pushing by the push button 51.

Of course, the stopper 48*a*, the pulling strings 44 and 50, the ratchet 48 and the stopper 48*a* may be employed by using various other equivalent means.

In order for the clamping unit 4 which is adapted to assemble the casing 21 of the transmission unit 6 and the switching unit 'A' to be installed irrespective of the type or size (width) of the wheelchair 2, it can be sliding-adjusted and set left and right to be matched with the size of the wheelchair 2 and then fixed by means of a locking screw 58. The driving rollers 30 at the both ends of the transmission unit 6 are adjusted to be moved and set left and right on the transmission shafts of the accelerating and decelerating parts 29, depending upon the interval between the both wheels 5*a* and then fixedly installed by means of the locking screw 58.

Figure 8:
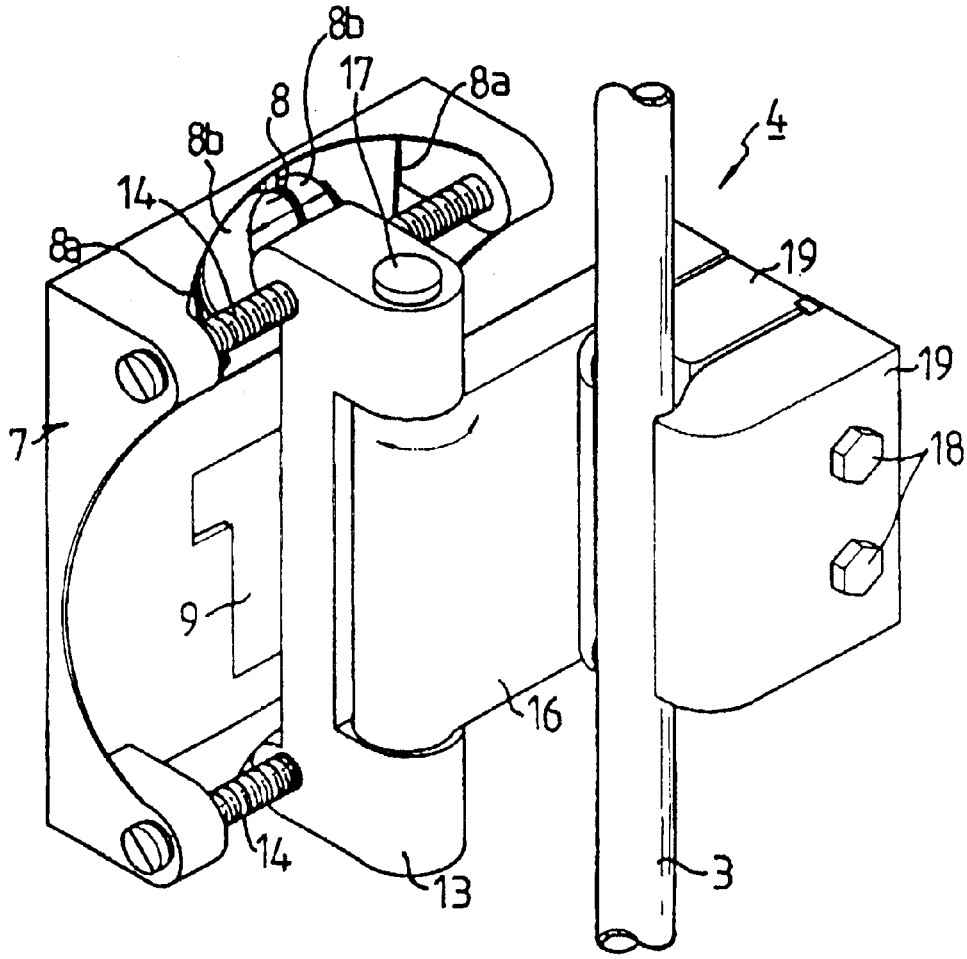
FIG. 8 is an enlarged perspective view showing another embodiment of the clamping unit of the present invention.
Figure 9:
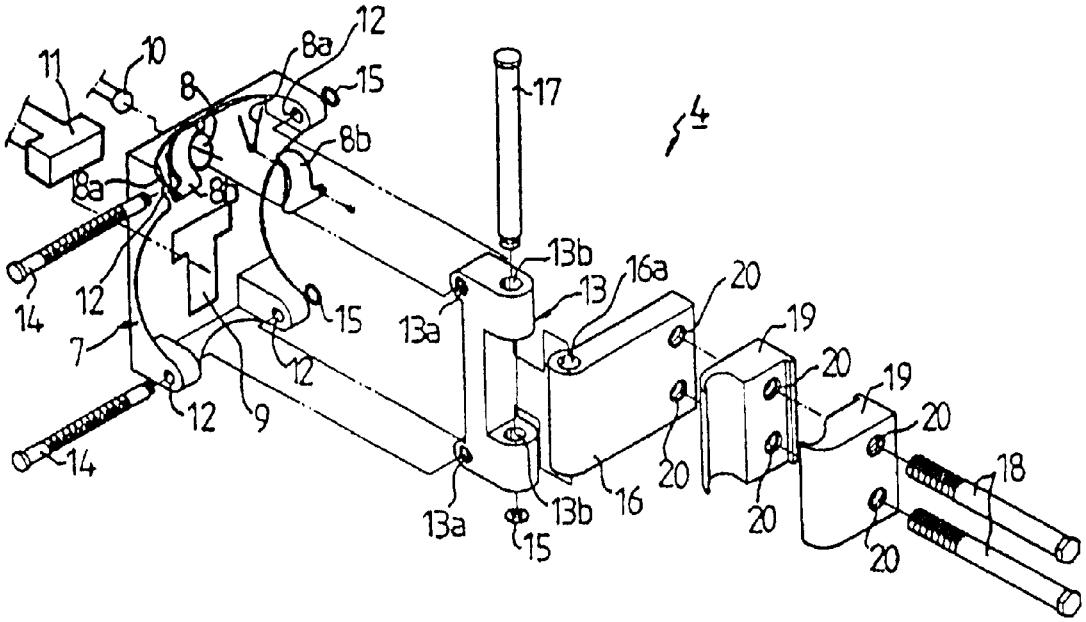
FIG. 9 is an exploded perspective view of FIG. 8.

FIGS. 8 and 9 show a second embodiment of the clamping unit 4 of the present invention.

In more detail, the clamping unit 4 is provided with a bracket 7 on which a coupling hole 8 and a guide hole 9 are formed on the upper and lower portions thereof. A climbing operation pin 10 drawn from the transmission unit 6 is fitting-inserted into the coupling hole 8 on the upper portion of the bracket 7, and a climbing guider 11 drawn from the transmission unit 6 is coupled on the guide hole 9 on the lower portion of the bracket 7. Preferably, the coupling hole 8 forms a locker 8*b* elastically installed by means of a twist spring 8*a* to thereby prevent the climbing operation pin 10 from being arbitrarily deviated therefrom and angle-moved to thereby lock the header portion of the climbing operation pin 10.

On the top and bottom portions of the bracket 7, respectively, a coupling hole 12 is formed left and right and horizontally, through which a left and right adjusting bar 13 with a female screw hole 13*a* is screw-installed by means of an adjusting bolt 14 and a snap ring 15, such that the left and right interval adjustment of the left and right adjusting bar 13 can be made depending upon the screw adjustment of the adjusting bolt 14.

On the front sides of the left and right adjusting bar 13, respectively, a shaft hole 13*b* is provided up and down, through which an angle adjusting bar 16 with a shaft hole 16*a* is fixed by means of a shaft pin 17 and a snap ring 15, such that the angle adjustment of the angle adjusting bar 16 can be made on the basis of the shaft pin 17. On the angle adjusting bar 16 is coupled a clamp 19 for clamping the frame 3 of the wheelchair 2 in a screw-tightening manner through a screw coupling hole 20 by means of a clamping bolt 18.

Figure 10:
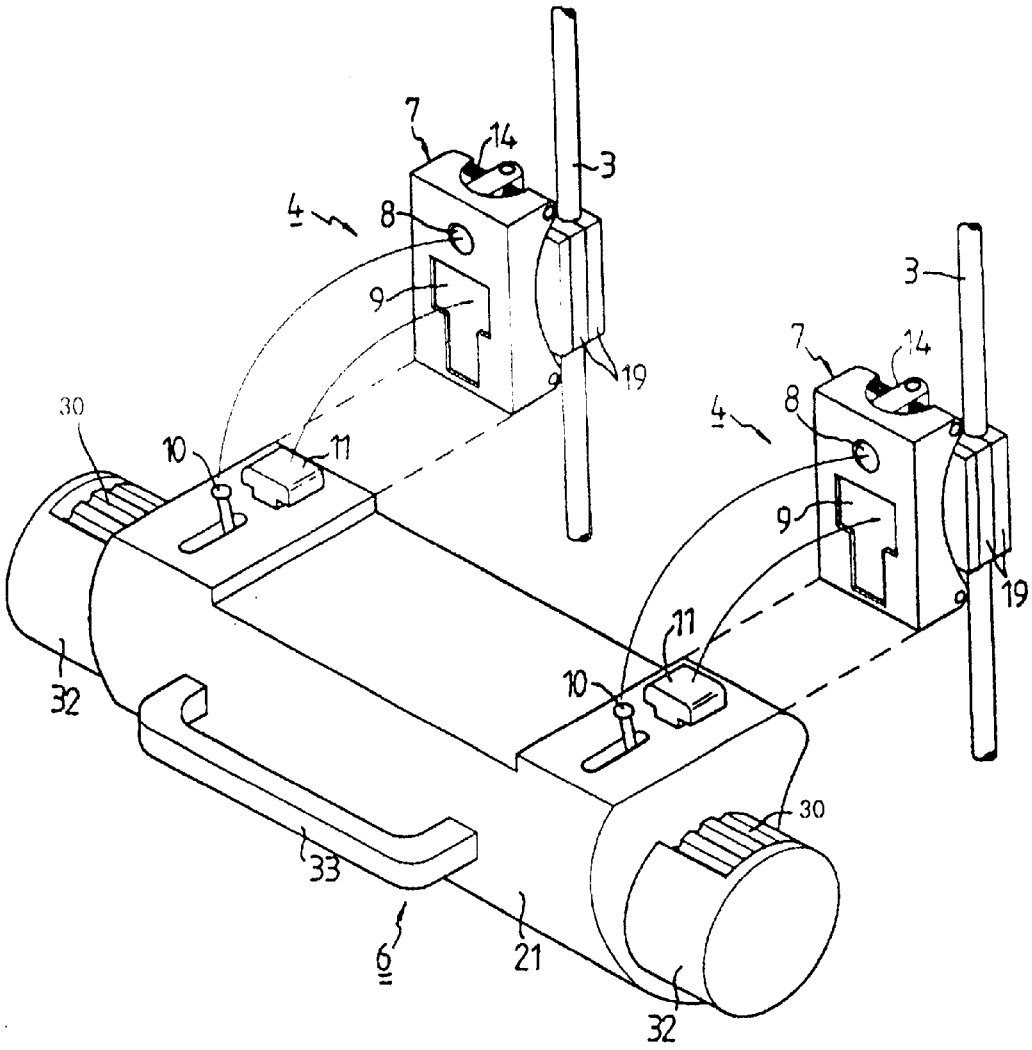
FIG. 10 is an exploded perspective view of the clamping unit and the transmission unit of the present invention.
Figure 11:
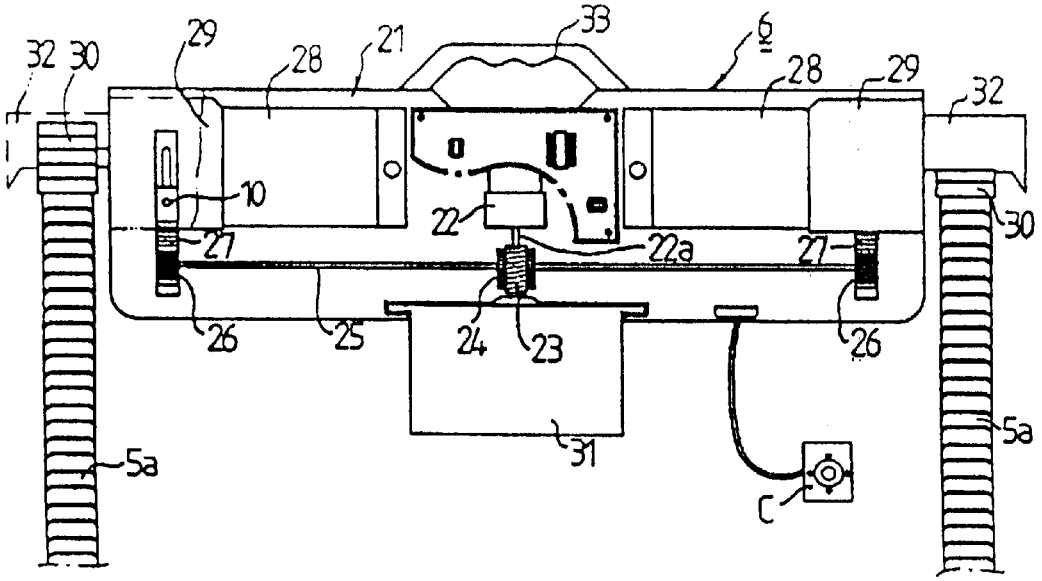
FIG. 11 is a top view showing the connection state of the transmission of the present invention with the wheels of the wheelchair, while being in a partly disconnected state.

The transmission unit 6 connected to the clamping unit 4 and the switching unit 'A' for selecting the manual and motor-driven ways can be of course employed in various other embodiments. FIGS. 10 and 11 show a second embodiment of the transmission unit 6 and the switching unit 'A' of the present invention.

In more detail, a climbing motor 22 is installed in the casing 21, and a worm gear 23 is shaft-fixed on a driving shaft 22*a* of the climbing motor 22. A worm gear 24, which is gear-engaged with the worm gear 23 in a right angle direction, is shaft-fixed on the center of a driven shaft 25, thereby being driven in the interconnected relationship with the worm gear 23. A pinion 26 is shaft-fixed on the both ends of the driven shaft 25, respectively, with which a rack gear 27 is gear-engaged, and the climbing operation pin 10 as mentioned above is fixedly formed on the opposite to the side on which the gear teeth of the rack gear 27 is formed.

The motor 28 is installed on the left and right sides of the interior of the casing 21, respectively and is coupled to the accelerating and decelerating part 29 having an output shaft on which the driving roller 30 is shaft-fixed, such that the driving roller 30 is selectively contacted with the wheel 5*a* of the wheelchair 2 for driving the wheel 5*a*.

The controller 'C' is separately provided to selectively drive the forward and reverse directions of the climbing motor 22 and the motor 28 and also to selectively accelerate and decelerate the rotation speed thereof. The controller 'C' can be used by any one of various kinds of well-known controllers.

The transmission of the present invention configured in various construction ways can drive and adjust the wheelchair 2 in a simple manner, such that there is an advantage that it is greatly convenient to work the transmission of the present invention. Now, an explanation of the use method of the present invention and the operation of each component will be in detail discussed.

The casing 21 of the transmission unit 6 is coupled to the fixing clip 38 by means of the clamping unit 4, and the fixing clip 38 is coupled to the assembling reentrant hole 35 of the fixing part 36 fixed on the frame 3 of the wheelchair 2. As a consequence, the transmission unit 6 is fixedly installed on the wheelchair 2 by means of the switching unit 'A', and the controller 'C' of the transmission unit 6 is disposed on the position where the user can be used in a convenient manner.

Under the installation of the transmission unit 6 as discussed above, if the motor 28 is controlled by means of the controller 'C' in the state where the driving roller 30 is installed to be in close contact with the wheel 5*a,* the driving roller 30 rotates depending upon the forward and reverse rotation directions of the motor 28, as shown in FIG. 2, thereby moving the wheelchair 2.

The driving roller 30 of the transmission unit 6 is controlled by means of the handle 39 on the top portion of the fixing clip 38, thus to be closely contacted and separated with/from the wheel 5*a,* such that the wheelchair 2 is selectively driven in the manual and motor-driven ways. Hereinafter, an explanation of the switching unit 'A' will be disclosed.

If the push button 51 presses, it is pushed and inserted in the inside of the switching unit 'A' and angle-moves the rotary plate 55, thereby operating the locker 41 and the stopper 48*a* each connected to the pulling strings 44 and 50.

If the stopper 48*a* pulls by means of the pulling string 50 by the pressing of the push button 51, the stopper 48*a* which has fixed the ratchet 48 of the rotary unit 47 of the handle 39 is released, such that the handle 39 lifts upward centering around the shaft pin 46. At the same time, while the pulling string 44 of the locker 41 pulls, the locking projection 40 each locked to the locking holes 37 of the fixing part 36 pulls in the inside thereof to be deviated from the locking hole 37, such that the locker 41 can lift upward.

If the handle 39 lifts upward in the state where the push button 51 has pressed, the pulling string 44, which is connected to the locker 41 and pulls the locking projection 44 in the inside thereof, pulls to thereby lift the locker 41 upward in the state where the locking projection 40 has been released to the locker 41. As a consequence, the locking projection 40, which has been released from the locking hole 37, is disposed in the inside of the fixing part 36.

Therefore, if the fixing clip 38 on which the locking projection 40 is released lifts to the upper portion of the fixing part 36, the whole casing 21 of the transmission unit 6 assembled with the fixing clip 38 slightly lifts upward, thereby permitting the driving roller 30 to be separated from the wheel 5*a,* such that the driving wheel 5 can move by the hand of the user, that is, the switching to the manually operated state is carried out.

If the switching to the motor-driven state is needed, the handle 39 is returned to its original position and accordingly the ratchet 48 is unlocked from the stopper 48*a* and returned to its original position. Thereby, the pulling string 44 of the locker 41 is returned and thus the locker 41 descends. As the locker 41 descends, if the locking projection 40 reaches the position of the locking hole 37 of the fixing part 36, it elastically protrudes outward and is fixedly locked to the locking hole 37 by the recovery force of the return spring 45 elastically formed between the both locking projections 40. Thereby, the casing 21 of the transmission unit 6 is fixed downward and the driving roller 30 is in close contact with the wheel 5*a,* such that the wheelchair 2 can be driven and moved under the control of the controller 'C' by the manipulation of the user.

On the other hand, an explanation of the operation according to the second embodiment of each of the clamping unit 4, the transmission unit 6 and the switching unit 'A' of the present invention will be in detail discussed.

In case of employing the clamping unit 4 as shown in FIGS. 8 and 9, in order to fix the clamping unit 4 on the frame 3 of the wheelchair 2, the clamping bolt 18 is first screw-separated to place the both clamps 19 on the top of the frame 3. Then, if the clamping bolt 18 is screw-tightened, the clamping unit 4 can be fixed on the frame 3. In the case where the left and right climbing operation pin 10 and the climbing guider 11 of the transmission unit 6 which are mounted on the clamping unit 4 have different left and right intervals, if the adjusting bolt 14 screw-coupled on the left and right adjusting bar 13 is screw-adjusted forwardly or reversely, the left and right adjusting bar 13 is sliding-adjusted left and right by a predetermined width to thereby set an appropriate left and right interval from the transmission unit 6. In the same manner as above, in case of the angle thereof, the angle adjusting bar 16 is angle-adjusted centering around the shaft pin 17.

In order to assemble the transmission unit 6 with the clamping unit 4, the climbing operation pin 10 and the climbing guider 11 of the transmission unit 6 are each assembled on the coupling hole 8 and the guide hole 9 of the clamping unit 4. In more detail, if the climbing operation pin 10 pushes and is then inserted into the coupling hole 8, the locker 8*b* elastically installed by the twist spring 8*a* is installed on the left and right of the coupling hole 8, such that the locker 8*b* opens in an angle-moved manner to the outer peripheral surface of the coupling hole 8 by the insertion of the climbing operation pin 10 and when the header portion of the climbing operation pin 10 is passed through the coupling hole 8, the locker 8*b* locks the rear side of the climbing operation pin 10 by the elastically recovering force of the twist spring 8*a* to thereby prevent the deviation of the climbing operation pin 10. On the other hand, the climbing guider 11 advances to the guide hole 9 and serves to a guider upon ascending up and down on the guide hole 9.

Upon completion of the assembly of the transmission unit 6 with the clamping unit 4, the disabled person is seated in the wheelchair 2 and drives the wheelchair 2 in the motor-driven way by the manipulation of the controller 'C' or rolls the driving wheel 5 in the manually operated way. In this case, since the manual driving method is well known, an explanation of which will be avoided for the brevity of the description. At this time, the driving roller 30 of the transmission unit 6 of the present invention is separated apart from the wheel 5*a*.

That is to say, the state as shown in FIG. 11 means the state where the worm gear 24 on the driven shaft 25 is driven by the rotation of the worm gear 23 connected on the driving shaft 22*a* by the operation of the climbing motor 22 and the pinion 26 is then raised from the rack gear 27 gear-engaged therewith by the rotation thereof. If the pinion 26 rises, since the clamping unit 4 is fixed on the frame 3 and the clamping unit 4 and the rack gear 27 are fixed through the climbing operation pin 10 and the coupling hole 8, the casing 21 of the transmission unit 6 ascends together with the pinion 26. As a consequence, the driving roller 30 shaft-fixed on the casing 21 is isolated from the wheel 5*a* and the driving wheel 5 is driven in the manually operated manner, for the driving of the wheelchair 2.

Figure 12:
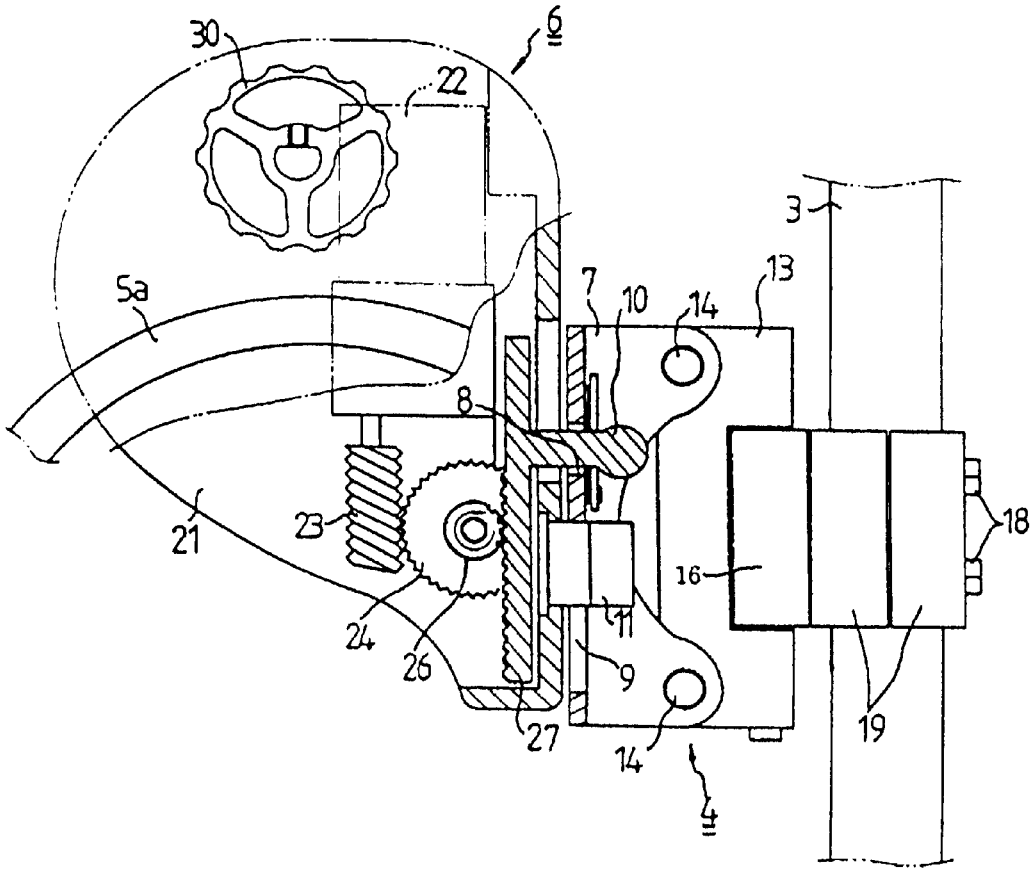
FIG. 12 is a side sectional view showing the separated state of the transmission of the present invention from the wheels of the wheelchair.
Figure 13:
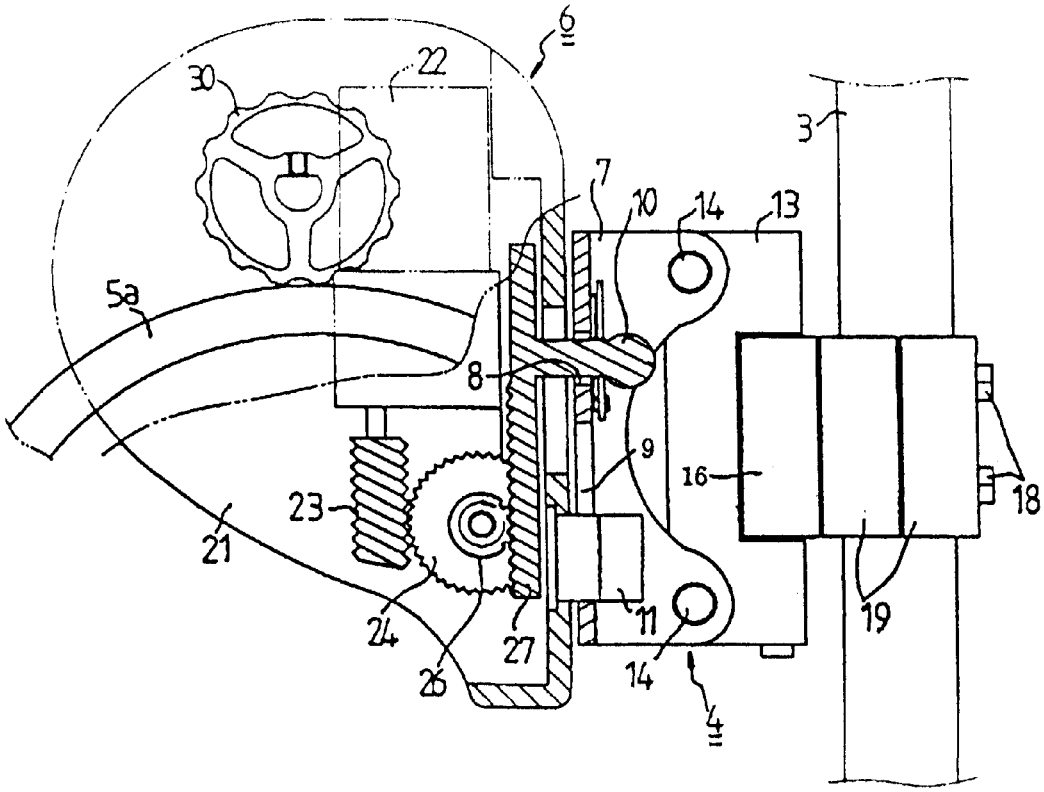
FIG. 13 is a side sectional view showing the motor-driven state where the transmission of the present invention is engaged with the wheels of the wheelchair.

FIG. 12 shows the case where the wheelchair 2 is driven by the operation of the transmission unit 6. At this time, the climbing motor 22 is driven in a reverse direction to as mentioned above and the worm gear 24 on the driven shaft 25 is driven by the rotation of the worm gear 23 connected on the driving shaft 22*a*. Thereby, the pinion 26 is rotated reversely and descends from the rack gear 27 gear-engaged therewith. If the pinion 26 descends, the casing 21 of the transmission unit 6 descends together with the pinion 26. As a consequence, the driving roller 30 shaft-fixed on the casing 21 is contact-engaged with the wheel 5*a,* and the motor 28 and the accelerating and decelerating part 29 are controlled and operated by the control of the controller 'C', thereby driving the driving roller 30. As a result, the driving rollers 30, which are engaged with the left and right wheels 5*a,* are driven in a constant rotation or at accelerating or decelerating rotation speed. Thus, if the wheelchair 2 is to be driven in a forward, left and right rotation, or reverse direction, it can be driven by the operation of the transmission unit 6.

INDUSTRIAL APPLICABILITY

As set forth in the foregoing, the transmission for the wheelchair according to the present invention can give the following advantages:

a) owing to its simple construction and convenient use method, it can provide the wheelchair all used in the manual and motor-driven ways; b) because of the compactness and light weight of a transmission unit, the overall weight of the wheelchair does not increase any more, such that a convenient use in the manual way can be ensured; c) because of the installation of left and right interval and angle adjusting means and a clamping unit easily fixed on a frame, the compatibility for various wheelchair sizes is provided: and d) since the transmission unit and the switching unit are assembled and dissembled to/from the clamping unit in a simple manner and ascend or descend to thereby isolate or engage the driving roller from/with the wheel, the reliability of operation is improved and owing to the simple construction, a relatively low production cost is determined.

It will be apparent to those skilled in the art that various modifications and variations can be made in a transmission for a wheelchair of the present invention without departing from the spirit or scope of the invention. Thus, it is intended that the present invention cover the modifications and variations of this invention provided they come within the scope of the appended claims and their equivalents.

What is claimed is:

1. A transmission for a wheelchair which is installed on a frame for said wheelchair, and for selecting and driving said wheelchair in manual and motor-driven ways, said transmission comprising:

a transmission unit installed on said wheelchair, for driving said wheelchair;

a clamping unit for fixing said transmission unit on said wheelchair; and a switching unit for switching said wheelchair in the manual and motor-driven ways;

wherein said transmission unit comprises, driving rollers coupled to accelerating and decelerating parts connected to motors on the both sides of the interior of a casing, for driving both wheels, and a controller circuit-connected to said motors, a motor control circuit unit and a battery, for adjusting said transmission unit, wherein said switching unit comprises, a fixing clip assembled by means of said clamping unit with said casing of said transmission unit and having a locking projection locked or unlocked to/from a locking hole of a fixing part fixed on said frame of said wheelchair, a locker elastically coupled with first and second springs on the top and bottom portions of the interior of said fixing clip and for pulling, upward by means of a handle, said locking projection elastically protruded on the both sides of said locker, respectively and locked or unlocked to/from said locking hole of said fixing part, a first pulling string connected to a push button elastically installed by means of a third spring on said handle, for pulling said locker with said locking projection by the pressing operation of said push button, to thereby isolate said driving rollers on the both sides of said transmission unit from said wheels, and a ratchet for controlling the manipulation of said handle by means of a stopper connected by a second pulling string to said push button of said handle.

2. The transmission according to claim 1, wherein said clamping unit comprises: a bracket forming a coupling hole having a locker elastically installed by means of a twist spring on the top side thereof and a guide hole on the bottom side thereof; a left and right adjusting bar screw-coupled on said bracket by means of upper and lower adjusting bolts, for adjusting the left and right interval; an angle adjusting bar shaft-fixed on said left and right adjusting bar by a shaft pin, for adjusting an angle; and a clamp clamped to said angle adjusting bar by means of a clamping bolt.

3. The transmission according to claim 1, wherein said switching unit installed in the interior of said transmission unit is configured in such a manner that a climbing motor is installed in said casing, a second worm gear which is gear-engaged with a first worm gear shaft-fixed on a driving shaft of said climbing motor is shaft-fixed on a driven shaft horizontally installed on said casing, a pinion is shaft-fixed on the both ends of said driven shaft, respectively, with which a rack gear is gear-engaged, said rack gear comprising a climbing operation pin assembled on said coupling hole of said clamping unit, and a climbing guider is attached on the one side of said casing, for guiding said transmission unit upon ascending said transmission unit and then coupled to said guide hole of said clamping unit.

* * * * *